US010229796B2

(12) United States Patent
Hirano

(10) Patent No.: US 10,229,796 B2
(45) Date of Patent: Mar. 12, 2019

(54) KEY SWITCH STRUCTURE

(71) Applicant: FANUC Corporation, Yamanashi (JP)

(72) Inventor: Kazuhiko Hirano, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 15/151,527

(22) Filed: May 11, 2016

(65) Prior Publication Data

US 2016/0336125 A1 Nov. 17, 2016

(30) Foreign Application Priority Data

May 13, 2015 (JP) ..... 2015-098452

(51) Int. Cl.

| | |
|---|---|
| ***H01H 13/14*** | (2006.01) |
| *H01H 13/705* | (2006.01) |
| *H01H 13/703* | (2006.01) |
| *H01H 13/702* | (2006.01) |
| *H01H 13/52* | (2006.01) |

(52) U.S. Cl.

CPC ..... *H01H 13/14* (2013.01); *H01H 13/52* (2013.01); *H01H 13/702* (2013.01); *H01H 13/703* (2013.01); *H01H 13/705* (2013.01); *H01H 2223/003* (2013.01)

(58) Field of Classification Search

CPC .. H01H 13/702; H01H 13/703; H01H 13/705; H01H 13/52; H01H 2223/003; H01H 2227/022; H01H 13/14; H01H 2215/004; H01H 13/48; H01H 2221/05

See application file for complete search history.

(56) References Cited

U.S. PATENT DOCUMENTS

| | | | | |
|---|---|---|---|---|
| 4,029,916 | A * | 6/1977 | Chu | H01H 13/7006 200/275 |
| 5,152,392 | A | 10/1992 | Iwasa | |
| 6,084,190 | A * | 7/2000 | Kenmochi | H01H 13/705 200/310 |
| 7,523,544 | B2 * | 4/2009 | Hsu | H01H 13/705 200/11 R |
| 2011/0162945 | A1 * | 7/2011 | Chen | H01H 13/83 200/314 |

FOREIGN PATENT DOCUMENTS

| | | |
|---|---|---|
| JP | 4-47616 A | 2/1992 |
| JP | 5-325717 A | 12/1993 |

(Continued)

OTHER PUBLICATIONS

Office Action in JP Application No. 2015-098452, dated Jun. 27, 2017.

*Primary Examiner* — Ahmed Saeed
(74) *Attorney, Agent, or Firm* — Hauptman Ham, LLP

(57) ABSTRACT

A key switch structure is provided with a key switch located in a position corresponding to a keyhole, a key top, and a key sheet disposed between the key switch and the key top. An embossed portion recessed inwardly relative to a case body is formed on the key sheet in a state where the key sheet is pressed down by a pressing protuberance of the key top not depressed, and tip corner parts of the pressing protuberance contact the formed embossed portion. Thus, the key top can be naturally positioned in the center position of the keyhole.

9 Claims, 3 Drawing Sheets

(56) References Cited

FOREIGN PATENT DOCUMENTS

| | | | |
|---|---|---|---|
| JP | 6-103851 | A | 4/1994 |
| JP | 108292829 | A | 11/1996 |
| JP | 2002075130 | A | 3/2002 |
| JP | 2004071429 | A | 3/2004 |
| JP | 2004-185893 | A | 7/2004 |
| JP | 2009-123631 | A | 6/2009 |
| JP | 2014-203677 | A | 10/2014 |

* cited by examiner

KEY SWITCH STRUCTURE

RELATED APPLICATIONS

The present application claims priority to Japanese Application Number 2015-098452, filed May 13, 2015, the disclosure of which is hereby incorporated by reference herein in its entirety.

BACKGROUND OF THE INVENTION

Field of the Invention

The present invention relates to a key switch structure.

Description of the Related Art

FIG. 5 is a view showing a conventional key switch structure.

In the key switch structure, a control panel comprising a key top 2 with a pressing protuberance 3, a key sheet 5 supported on a key sheet reinforcement plate 7, and a key switch 6 mounted on a key base 8 is disposed in a case body 1. If the center position of the key top 2 is not aligned with the center position of a keyhole 11 in the case body 1 of the key switch structure of this type, as shown in FIG. 5, a gap between the key top 2 and the inner wall surface of the keyhole 11 is not uniform throughout the circumference of the key top 2, so that the external appearance is poor. Further, a problem easily occurs that the key top 2 is caught by the edge of the keyhole 11 in the case body 1 when its corner is pressed.

Thus, it is advisable that the key top 2 be located near the center position of the keyhole 11 in the case body 1 so that the gap between the key top 2 and the inner wall surface of the keyhole 11 is uniform throughout the circumference of the key top 2.

Japanese Patent Applications Laid-Open Nos. 2004-071429, 8-292829 and 2002-075130 disclose techniques in which a positioning mechanism is provided to a key switch structure such that a key switch is positioned in the center position of a keyhole by the positioning mechanism.

In the positioning techniques as described in the above patent documents, however, a special mechanism is needed to align the center position of the key top with the center position of the keyhole, so that there are problems of increased manufacturing costs and time-consuming assembly.

SUMMARY OF THE INVENTION

Accordingly, the object of the present invention is to provide a key switch structure designed so that a key top can be aligned with the center position of a keyhole without any positioning mechanism incorporated.

A key switch structure according to the present invention comprises a case body with at least one keyhole, a key base disposed in the case body, a key switch located on the key base in a position corresponding to the keyhole, a key top, and a key sheet disposed between the key switch and the key top. The key top comprises a pressing protuberance configured to depress the key switch through the key sheet when pressed. Further, an embossed portion that is embossed to protrude toward the inside of the case body is formed on the key sheet in a state where the key sheet is pressed down by the pressing protuberance with the key top not depressed. Tip corner parts of the pressing protuberance are configured to contact the formed embossed portion in a fitted manner.

The tip corner parts of the pressing protuberance may be circular arc-shaped.

The key sheet may comprise a wall portion surrounding the embossed portion, and the inner diameter of under-side internal surface end portions of the key top may be substantially equal to the outer diameter of a root part of the wall portion.

According to the present invention, the tip corner parts of the pressing protuberance of the key top contact circular arc-shaped parts on the key sheet, so that the key top is guided to the center of the keyhole and positioned in the center position of the keyhole. Thus, the external appearance is good and the problem of the key top being caught when its corner is pressed can be substantially suppressed.

BRIEF DESCRIPTION OF THE DRAWINGS

The above and other objects and features of the present invention will be obvious from the ensuing description of embodiments with reference to the accompanying drawings, in which.

DETAILED DESCRIPTION OF THE PREFERRED EMBODIMENTS

According to the present invention, the above-described problems are solved by machining a part of a key sheet that constitutes a key switch structure, which touches a pressing protuberance of a key top, into an emboss shape.

Figure 1A:
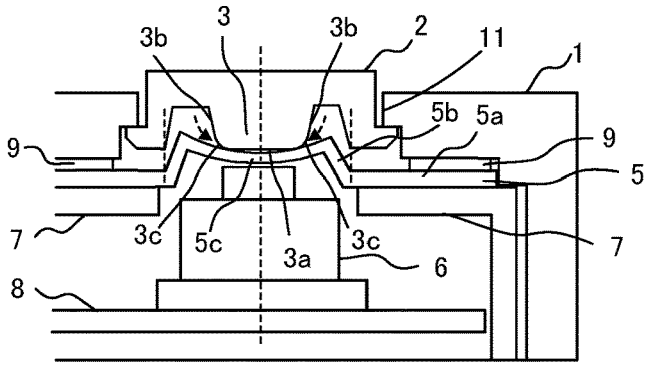
FIGS. 1A and 1B are sectional views of a key switch structure according to one embodiment of the present invention.
Figure 1B:
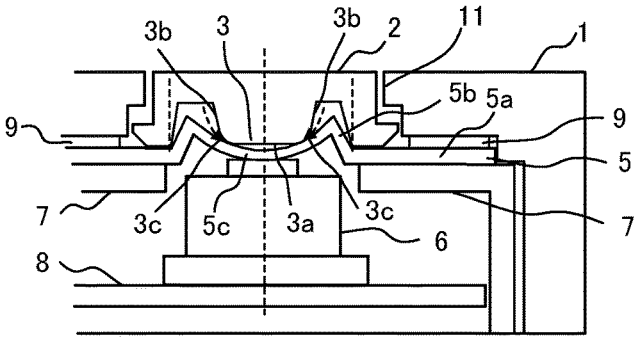

FIGS. 1A and 1B are sectional views of a key switch structure according to one embodiment of the present invention.

This key switch structure mainly comprises a key top 2 with a pressing protuberance 3, a key sheet 5 supported on a key sheet reinforcement plate 7, and a key switch 6 mounted on a key base 8.

The pressing protuberance 3 of the key top 2 comprises a tip portion 3*a*, side portions 3*b*, and tip corner parts 3*c*. The tip portion 3*a* is configured to press the key switch 6 through the key sheet 5 when the key top 2 is depressed. The tip corner parts 3*c* are boundaries between the tip portion 3*a* and the side portions 3*b*.

Further, the key sheet 5 comprises a flat portion 5*a*, which serves as a base of the key sheet, and a wall portion 5*b* with a circular cross-section. The wall portion 5*b* serves to raise, outward from a case body 1, a part of the key sheet 5 which corresponds to a keyhole in the case body 1 when the key sheet 5 is affixed to the case body 1 with an adhesive 9.

In this key switch structure, the respective heights of the wall portion 5*b* of the key sheet 5 and the side portions 3*b* of the pressing protuberance 3 are designed so that a part of the key sheet 5 surrounded by the wall portion 5*b* is embossed so as to protrude inwardly toward the inside of the case body 1 so as to form an embossed portion 5*c* having a circular-arc shape, when pressed down by the pressing protuberance 3 of the key top 2, in a state where the key top 2 is not depressed by an operator (in a normal mode shown in FIG. 1A) with the key top 2 and the key sheet 5 mounted in the case body 1.

With the key switch structure constructed in this manner, the tip corner parts 3*c* of the pressing protuberance 3 in contact with the embossed portion 5*c* of the key sheet 5 are guided in the directions of dotted-line arrows in FIG. 1A (i.e., direction toward the center position of the keyhole 11) by a stress from the embossed portion 5*c*. Consequently, the center position of the key top 2 is naturally positioned in the center position of the keyhole 11.

Further, if the pressing protuberance 3 of the key top 2 is depressed, as shown in FIG. 1B, the embossed portion 5*c* of the key sheet 5 is more deformed than when it is normally pressed by the pressing protuberance 3, as shown in FIG. 1A, and a slope steeper than a normal one is formed inclined downward toward the center position of the keyhole 11. Consequently, a force to guide the pressing protuberance 3 toward the center position of the keyhole 11 increases, so that the key top 2 can be positioned in the center position of the keyhole 11 without being deviated from it.

The effect of the present invention can be obtained without rounding the tip corner parts 3*c* of the pressing protuberance 3 of the key top 2. However, if the tip corner parts 3*c* are rounded and circular arc-shaped, as shown in FIG. 1, friction on the circular-arc contact surface of the embossed portion 5*c* of the key sheet 5 is reduced, so that a force to urge the center position of the key top 2 toward the center position of the keyhole 11 can be increased.

Figure 2:
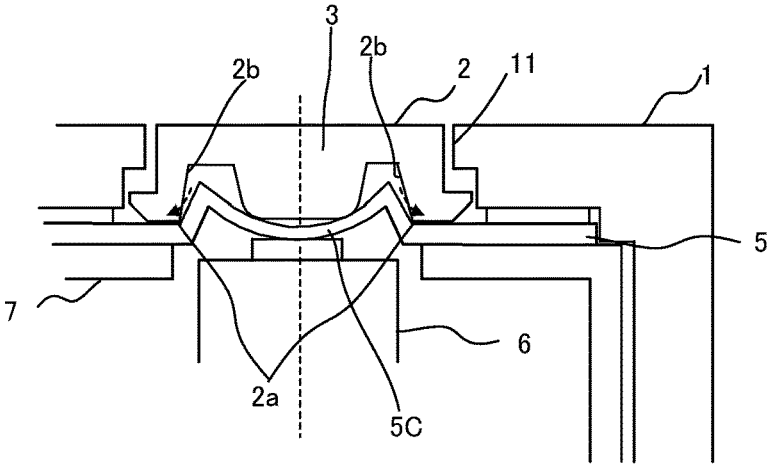
FIG. 2 is a view illustrating how under-side internal surface end portions of a key top are guided in the directions of dotted-line arrows and the center position of the key top is strongly positioned in the center position of a keyhole when the key top is depressed, in the key switch structure according to the one embodiment of the invention.

Further, FIG. 2 shows the pressing protuberance 3 of the key top 2 in a pressed state.

The under-side internal surface of the key top 2 is provided with an inclination (slopes 2*b*), and the wall portion 5*b* of the key sheet 5 is inclined toward the center of the embossed portion 5*c* so that the inner diameter of under-side internal surface end portions 2*a* of the key top 2 is substantially equal to the outer diameter of a root part of the wall portion 5*b* of the key sheet 5 (i.e., the boundary between the flat portion 5*a* and the wall portion 5*b*). In this way, when the pressing protuberance 3 of the key top 2 shown in FIG. 2 is depressed, the under-side internal surface end portions 2*a* of the key top 2 is guided in the directions of dotted-line arrows in FIG. 2. Thus, with a force to guide the portions 2*a* of the key top 2 and a force to guide the pressing protuberance 3 of the key top 2 by the embossed portion 5*c* of the key sheet 5 toward the center position of the keyhole 11, the center position of the key top 2 is strongly positioned in the center position of the keyhole 11. Consequently, the gap between the key top 2 and the inner wall surface of the keyhole 11 becomes substantially uniform throughout the circumference of the key top 2.

Figure 3:
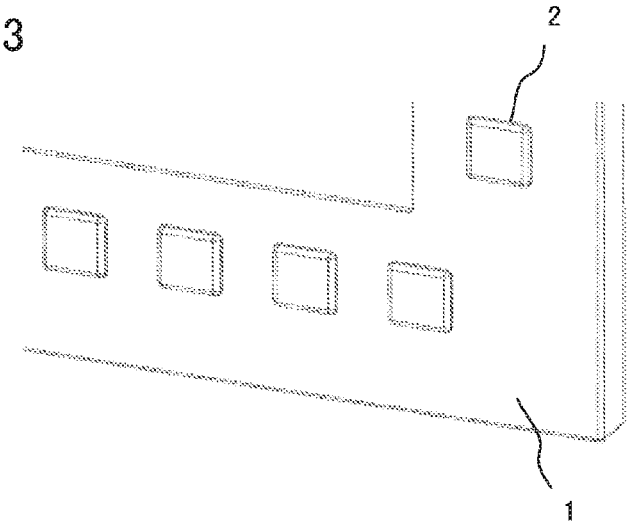
FIG. 3 is an exterior view of a control panel in which the key switch structure according to the one embodiment of the invention is incorporated.
Figure 5:
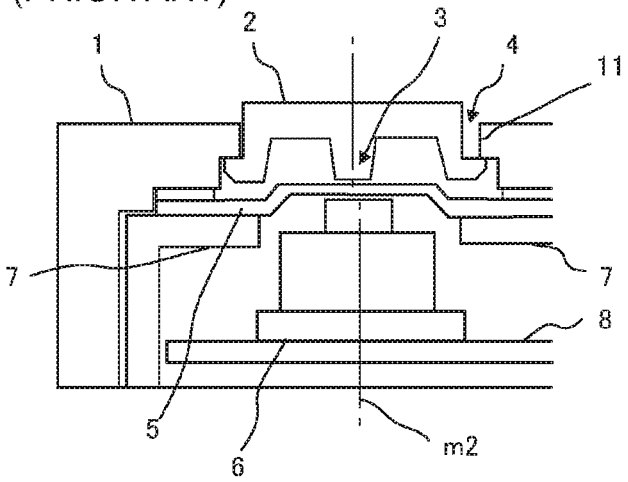
FIG.5 (PRIOR ART)
FIG. 5 is a view showing an example of a prior art key switch structure.

FIG. 3 is an exterior view of a control panel into which the key switch structure according to the present invention is incorporated.

Even in the case where the control panel is vertically set, as shown in FIG. 3, the pressing protuberance 3 of the key top 2 is slightly pressed against the embossed portion 5*c* of the key sheet 5 positioned within the case body 1, so that the position of the key top 2 can be naturally positioned in the center position of the keyhole 11 without being deviated downward by gravity.

While an embodiment of the present invention has been described herein, the invention is not limited to the above-described embodiment and may be suitably modified and embodied in various forms.

Figure 4A:
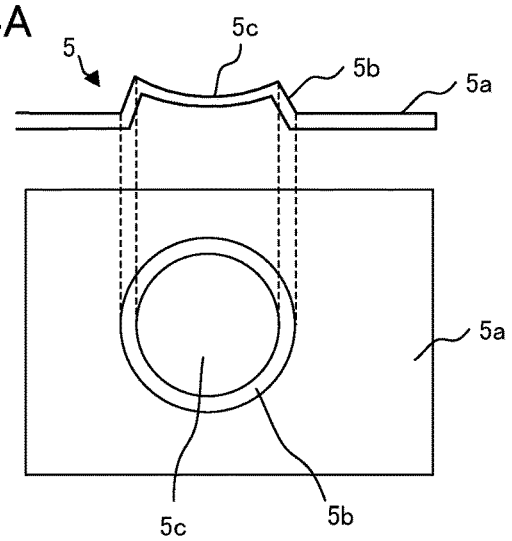
FIGS. 4A, 4B and 4C are views showing alternative forms of a key sheet in the key switch structure shown in FIG. 1A.

In the description of the above embodiment, for example, the embossed portion 5*c* is assumed to be formed as the pressing protuberance 3 of the key top 2 is depressed by the part of the key sheet 5 surrounded by the wall portion 5*b*. Alternatively, however, the embossed portion 5*c* may be formed in advance in the key sheet 5, as shown in FIG. 4A.

Figure 4B:
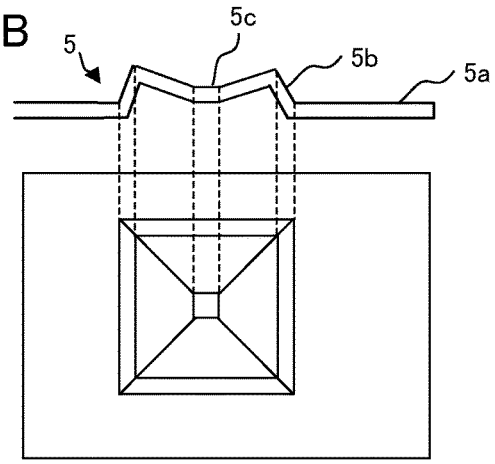
Figure 4C:
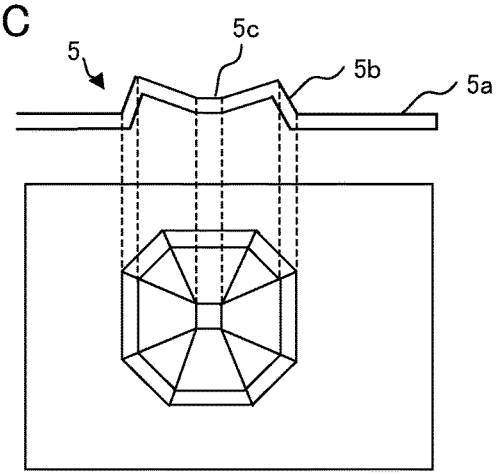

In the above-described embodiment, moreover, the wall portion 5*b* of the key sheet 5 is formed in a circular shape, while the embossed portion 5*c* is formed in a circular arc shape. However, if the pressing protuberance 3 of the key top 2 is formed in a rectangular shape, for example, the wall portion 5*b* of the key sheet 5 may be formed rectangular, and in this case, the embossed portion 5*c* may be formed inclined and embossed toward the inside of the case body, as shown in FIG. 4B. Likewise, if the pressing protuberance 3 of the key top 2 is formed in an octagonal shape, the wall portion 5*b* of the key sheet 5 may be formed to be octagonal, as shown in FIG. 4C. In any case, a force urges the center of the key top 2 toward the center of the keyhole, thereby achieving the effect of the present invention.

The invention claimed is:

1. A key switch structure, comprising:

a case body with at least one keyhole;

a key base disposed in the case body;

a key switch located on the key base in a position corresponding to the keyhole;

a key top; and a key sheet disposed between the key switch and the key top, wherein the key top comprises a pressing protuberance configured to depress the key switch through the key sheet when the key top is depressed, an embossed portion that is embossed to protrude toward an inside of the case body is formed on the key sheet in a state where the key sheet is pressed down by the pressing protuberance while the key top is not depressed, the embossed portion has a concaved region concaved at a first inclination when the key top is not depressed, the embossed portion is configured to be deformed by the pressing protuberance so that the concaved region is concaved at a second inclination when the key top is depressed, the second inclination being greater than the first inclination, and tip corner parts of the pressing protuberance are configured to contact the formed embossed portion in a fitted manner.

2. The key switch structure according to claim 1, wherein the tip corner parts of the pressing protuberance are circular arc-shaped.

3. The key switch structure according to claim 1, wherein the key sheet comprises a wall portion surrounding the embossed portion, and an inner diameter of under-side internal surface end portions of the key top is substantially equal to an outer diameter of a root part of the wall portion.

4. The key switch structure according to claim 1, wherein the key top includes an under-side internal surface having an inclined portion, and the key sheet includes a wall portion that is inclined toward a center of the embossed portion.

5. The key switch structure according to claim 4, wherein the pressing protuberance of the key top has a rectangular shape, and the wall portion has a rectangular shape.

6. The key switch structure according to claim 1, wherein the embossed portion is formed in advance in the key sheet rather than formed in the key sheet in a state where the key sheet is pressed down by the pressing protuberance with the key top not depressed.

7. The key switch structure according to claim 1, wherein a peripheral part of the embossed portion protrudes toward the pressing protuberance.

8. The key switch according to claim 1, wherein an entirety of a center portion of the embossed portion is substantially flat.

9. The key switch according to claim 1, wherein the key top is positioned in a center portion of the key hole.

* * * * *